US005591307A

United States Patent [19]

Storeck

[11] Patent Number: 5,591,307

[45] Date of Patent: Jan. 7, 1997

[54] PAPER CONTAINING A FILLER

[75] Inventor: Arnold Storeck, Frankfurt, Germany

[73] Assignee: Degussa Aktiengesellschaft, Frankfurt am Main, Germany

[21] Appl. No.: 454,604

[22] Filed: May 31, 1995

Related U.S. Application Data

[63] Continuation of Ser. No. 322,362, Oct. 13, 1994, abandoned, which is a continuation of Ser. No. 185,076, Jan. 24, 1994, abandoned.

[30] Foreign Application Priority Data

Jan. 28, 1993 [DE] Germany ..... 43 02 293.6

[51] Int. Cl.[6] ..... D21H 17/68

[52] U.S. Cl. ..... 162/181.6; 162/150; 162/164.4; 162/181.7

[58] Field of Search ..... 162/181.6, 150, 162/158, 164.4, 181.7

[56] References Cited

U.S. PATENT DOCUMENTS

| | | | |
|---|---|---|---|
| 2,296,637 | 9/1942 | Hanahan | 106/308 |
| 2,399,981 | 8/1946 | Britt | 162/181.7 |
| 3,227,607 | 1/1966 | Mays et al. | 162/181 |
| 4,001,379 | 1/1977 | Turk | 423/339 |
| 4,003,981 | 1/1977 | Turk | 423/335 |
| 4,117,191 | 9/1978 | Kurrle | 428/330 |
| 4,198,269 | 4/1980 | Evani et al. | 162/164.1 |
| 4,260,454 | 4/1981 | Wason et al. | 162/181 |
| 4,336,245 | 6/1982 | Wason | 424/49 |
| 4,681,750 | 7/1987 | Johnson et al. | 423/339 |
| 4,895,759 | 1/1990 | Crawford | 162/155 |
| 4,902,568 | 2/1990 | Morohoshi | 428/331 |
| 5,094,829 | 3/1992 | Krivak et al. | 423/339 |
| 5,240,561 | 8/1993 | Kaliski | 162/138 |
| 5,279,663 | 1/1994 | Kaliski | 106/486 |

FOREIGN PATENT DOCUMENTS

| | | | |
|---|---|---|---|
| 732522 | 4/1966 | Canada | 9/65 |
| 2007141 | 8/1993 | France | 162/181 |
| 1546281 | 4/1970 | Germany . | |
| 3703678 | 8/1987 | Germany . | |
| 03033298 | 2/1991 | Japan | 162/181 |
| 147016 | 3/1969 | New Zealand . | |
| 226240 | 10/1989 | New Zealand . | |
| 228206 | 4/1990 | New Zealand . | |
| 228472 | 1/1993 | New Zealand . | |

OTHER PUBLICATIONS

Database WPI, Derwent Public. Ltd., AN 91–089886, JP–A–3 033 298.

Chem.–Ing.–Tech. vol. 48, Nr. 11 (1976), pp. 922–933.

*Primary Examiner*—Donald E. Czaja
*Assistant Examiner*—Jose A. Fortuna
*Attorney, Agent, or Firm*—Cushman Darby & Cushman IP Group of Pillsbury Madison & Sutro LLP

[57] ABSTRACT

Paper containing a filler which is synthetic silica, which can be precipitated, spray-dried and ground. The synthetic silica reduces show through.

5 Claims, 2 Drawing Sheets

PAPER FACTORY 4

PAPER CONTAINING A FILLER

This is a continuation of application Ser. No. 08/322,362, filed on Oct. 13, 1994, which was abandoned upon the filing hereof which is a continuation of 08/185,076, filed on Jan. 24, 1994, now abandoned.

The present invention relates to paper containing a filler having reduced show through.

BACKGROUND OF THE INVENTION

After the introduction of offset printing of newsprint at the beginning of the 1970's, it became possible for newspapers to print in four colors. In order to be acceptable to advertisers, who contribute to the finances of newspapers, four-color newspapers need to be printed on much better paper than necessary without four-color printing. The main criteria are reduced print-through of printing ink, greater whiteness and a sufficiently high coefficient of friction of the paper surface.

Reduced print-through is necessary because the paper goes through a printer not once but four times. A high degree of whiteness is necessary if four-color printing is to be possible at all. The coefficient of friction has to be sufficiently high to prevent slipping in the printing press and thus ensure the register which is so important for four-color printing.

In North America and Scandinavia, newsprint paper is conventionally made from virgin fibers. TMP fibers are used in Scandinavia, and considerable quantities of mechanical wood pulp in Canada. This means it is necessary to include cellulose in the formulation to obtain the required strength. A common feature of these methods, until recently, was substantial non-use of waste paper. In Central Europe this goes back to a long tradition including newsprint paper.

Admittedly, newsprint-paper manufacturers in Scandinavia and in the USA and Canada are making increased use of waste paper, encouraged in North America by Government intervention by legislation in the principal states in the USA. In these regions, however, pristine fibers will never lose their fundamental importance, if only because pristine fibers always have to be introduced for technical reasons even if fiber recycling is intensified.

The higher the pristine fiber content, the more urgent is the need, given the nature of the demand for newsprint paper as described above, to reduce the print-through to an acceptable amount, owing to the absence of fillers inevitably supplied via the waste paper. Normally print-through is reduced by increasing the opacity of the paper, i.e. increasing the weight per unit area or the content of pigment, and consequently a necessary proportion of fillers is desirable to a certain extent, to give subsequent strength to the paper. This does not—or to a decreasing extent, relieve paper manufacturers of the need at least to think about deliberate incorporation of fillers which are not supplied via waste paper. This will be essential if no waste paper is used. This is confirmed by the reaction of the Swedish paper industry.

SUMMARY OF THE INVENTION

The object of the present invention therefore is to provide a paper which does not permit printing ink to print through.

The present invention provides paper containing a filler, characterized in that the filler is synthetic silica. The synthetic silica can be precipitated silica. In a preferred embodiment the synthetic silica is spray-dried and ground.

The precipitated, spray-dried, ground silica can have the following physical and chemical characteristics:

| | | |
|---|---|---|
| BET surface area[1)] | $m^2/g$ | 190 |
| Average size of agglomerates | μm | 7 |
| Tapped density[2)] | g/l | 120 |
| Loss on drying (2 hours at 105° C.)[3)] | % | 6 |
| Loss on ignition (2 hours at 1000° C.)[4)9)] | % | 5 |
| pH (in 5% aqueous dispersion)[5)] | | 6.3 |
| DBP absorption[6)9)] | g/100 g | 270 |
| $SiO_2$[10)] | % | 98 |
| $Na_2O$[10)] | % | 1 |
| $Fe_2O_3$[10)] | % | 0.03 |
| $SO_3$[10)] | % | 0.8 |
| Retained on screen (According to Mocker, 45 μm)[7)] | % | 0.1 |

[1)]to DIN 66 131
[2)]to DIN ISO 787/XI, JIS K 5101/18 (not screened)
[3)]to DIN ISO 787/II, ASTM D 280, JIS K 5101/21
[4)]to DIN 55921, ASTM D 1208, JIS K 5101/23
[5)]to DIN ISO 787/IX, ASTM D 1208, JIS K 5101/24
[6)]to DIN 53601, ASTM D 2414
[7)]to DIN ISO 787/XVIII, JIS K 5101/20
[9)]Referred to substance dried at 105° C. for 2 25 hours
[10)]Referred to substance calcined at 1000° C. for 2 hours This silica, called SIPERNAT 22 S—was also used in the example.

The paper according to the invention can contain 0.5 to by weight of silica, preferably 1 to 2% by weight.

In a particularly preferred embodiment, the filler containing paper is newsprint paper.

The advantage of the invention is that print-through of printing ink can be reduced by almost 60%.

DETAILED DESCRIPTION OF PREFERRED EMBODIMENT

The invention is illustrated by the following examples:

The experiments on using silica in newsprint paper were carried out between 1989 and 1991 on the North American Continent, preferably in Canada but also in the USA and in South America. In all cases, pristine fibers were exclusively used. The paper experimentally obtained on the paper-making machine was then printed on commercial offset machines, in one case actually using a newspaper-printing machine at a European publisher, and were then optically evaluated. The optical evaluation concentrated on evaluating the print-through of printing ink. All the test results described below, therefore, are not laboratory results but extremely realistic—the paper came from the paper-making machine, not from a sheet-forming device, and printing was not by an IGT or Prüfbau test device but in a real printing machine!

Figure 1:
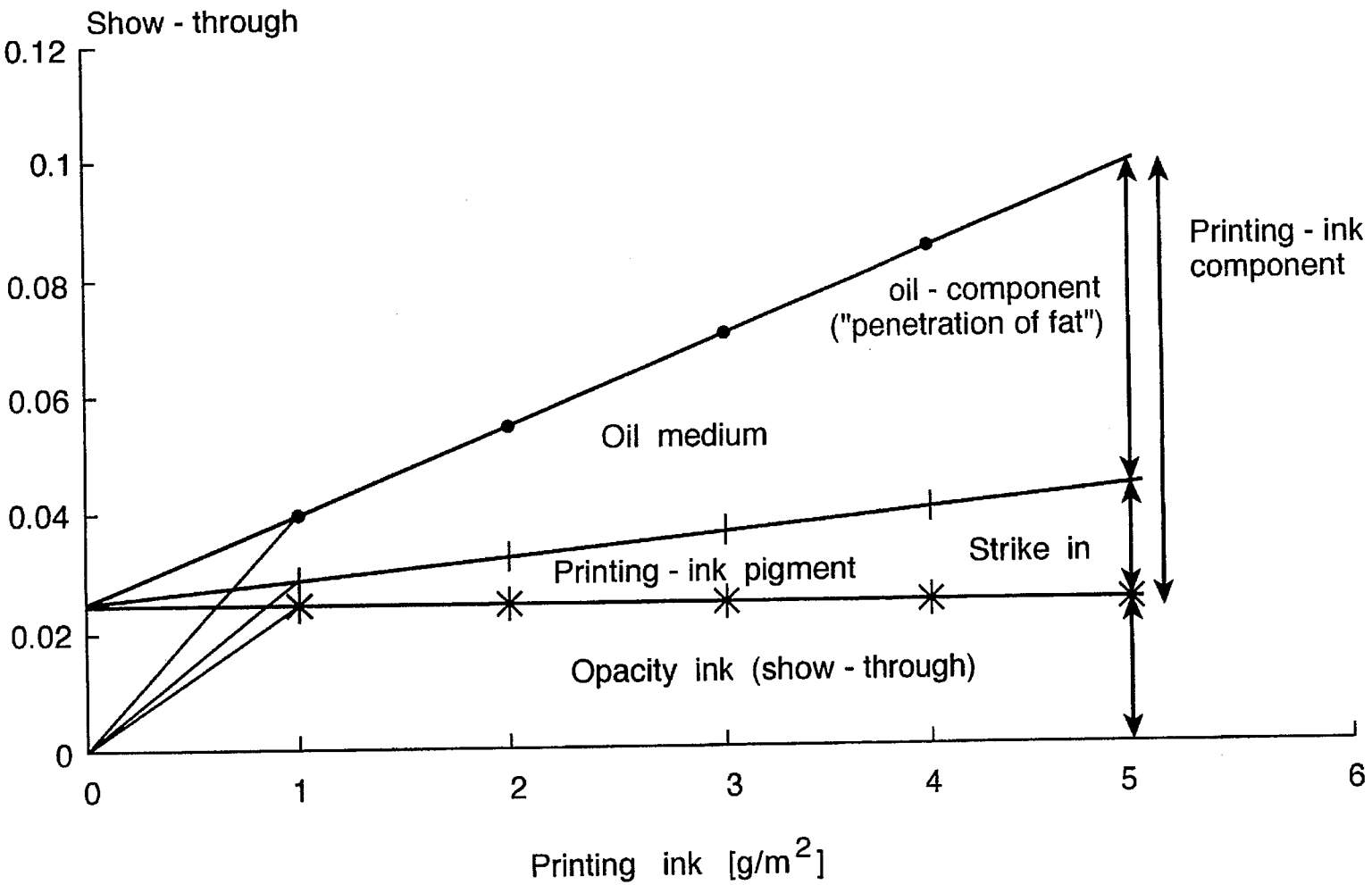

For better understanding of the results, FIG. 1 diagrammatically shows how the print-through of printing ink is made up in linear manner from the paper component and the printing-ink component. Whereas the capacity of the finished paper is constant, the print-through depends on the amount of printing ink applied. Of course, the print through can be reduced by increasing the opacity of the paper with suitable pigments. This method is often used. If, however, the printing-ink component can be influenced, this is also a way of reducing print-through. Admittedly the effect is detectable only after printing and not before, i.e. not on the paper-making machine. The overall term for this in the English language is "printed opacity".

Figure 2:
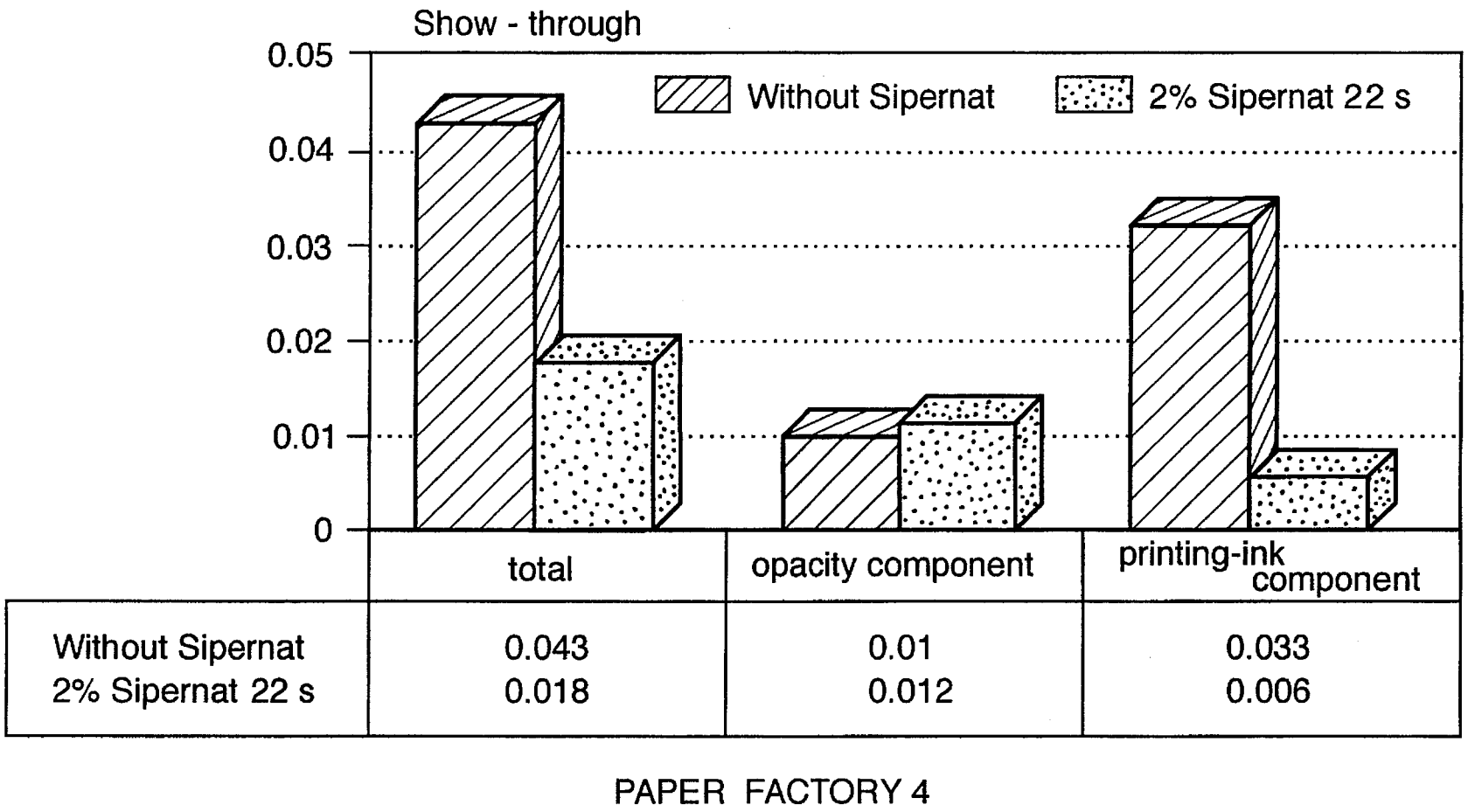

FIG. 2 shows successful use of SIPERNAT 22 S, an amorphous silica produced by the firm DEGUSSA AG. SIPERNAT 22 S absorbs twice or even three times its weight of oil. In this case, exclusively as a result of the printing-ink component, the print-through was reduced by about 60%, from 0.043 to 0.018.

BRIEF DESCRIPTION OF FIGURES OF DRAWING

In the drawings,

FIG. 1 is a graph which shows diagrammatically the opacity (show through) of printing ink as a function of the amount of printing ink applied; and FIG. 2 is a bar graph which shows the reduction of print-through as a result of the present invention.

What is claimed is:

1. Newsprint paper containing, as a filler, 0.5 to 3% by weight precipitated silica which has been spray-dried and ground wherein the precipitated, spray dried, ground silica has the following characteristics:

| | | |
|---|---|---|
| BET surface area | $m^2/g$ | 190 |
| Average size of agglomerates | μm | 7 |
| Tapped Density | g/l | 120 |
| Loss on drying (2 hours at 105° C.) | % | 6 |

-continued

| | | |
|---|---|---|
| Loss on ignition (2 hours at 1000° C.) | % | 5 |
| pH (in 5% aqueous dispersion) | | 6.3 |
| DBP absorption | g/100 g | 270. |

2. Newsprint paper according to claim 1 or 5 wherein the precipitated, spray dried, ground silica is further characterized by:

| | | |
|---|---|---|
| $SiO_2$ | % | 98 |
| $Na_2O$ | % | 1 |
| $Fe_2O_3$ | % | 0.03 |
| $SO_3$ | % | 0.8 |
| Retained on screen (according to Mocker, 45 μm) | % | 0.1. |

3. Newsprint paper according to claim 1 characterized as having an opacity component of approximately 0.012 and has a show-through value of less than 0.02.

4. Newsprint paper as set forth in claim 1 which includes pristine fibers.

5. Paper as set forth in claim 4 which the paper contains only pristine fibers.

* * * * *